US010443209B2

(12) United States Patent
Kumbhar et al.

(10) Patent No.: US 10,443,209 B2
(45) Date of Patent: Oct. 15, 2019

(54) BOOM CONFIGURATION FOR A SKID STEER LOADER

(71) Applicant: Deere & Company, Moline, IL (US)

(72) Inventors: Nilesh T. Kumbhar, Pune (IN); Travis A. Shekleton, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 332 days.

(21) Appl. No.: 15/292,400

(22) Filed: Oct. 13, 2016

(65) Prior Publication Data

US 2018/0106011 A1 Apr. 19, 2018

(51) Int. Cl.
*E02F 3/34* (2006.01)
*E02F 3/42* (2006.01)

(52) U.S. Cl.
CPC ..... *E02F 3/3414* (2013.01); *E02F 3/3405* (2013.01); *E02F 3/422* (2013.01)

(58) Field of Classification Search
CPC ..... E02F 3/3405; E02F 3/3408; E02F 3/3411; E02F 3/3414; E02F 3/38; E02F 3/422
USPC ..... 414/685, 700, 728, 742
See application file for complete search history.

(56) References Cited

U.S. PATENT DOCUMENTS 5,609,464 A * 3/1997 Moffitt ..... E02F 3/3405 414/685
6,866,466 B2 3/2005 Roan et al.
8,545,162 B2 10/2013 Hackett et al.
2005/0133294 A1* 6/2005 Jung ..... B62D 5/12 180/414
2014/0212254 A1* 7/2014 Martin ..... E02F 3/3405 414/680

* cited by examiner

*Primary Examiner* — Saul Rodriguez
*Assistant Examiner* — Brendan P Tighe
(74) *Attorney, Agent, or Firm* — Michael Best & Friedrich LLP

(57) ABSTRACT

A vehicle includes a frame, an engine connected to the frame and operable to move the vehicle, an operator cab, a tool, and a boom arm. The boom arm includes a first linkage, a second linkage and a cylinder. The first linkage has a first portion connected to the frame and a second portion spaced from the frame. The second linkage has a first portion connected to the second portion of the first linkage and a second portion connected to the tool, the second linkage movable during boom operation within a first plane. The cylinder has a first portion connected to the first linkage and a second portion connected to the second linkage, such that the first linkage and the cylinder are movable during boom operation within a second plane. The first plane is offset from the second plane.

6 Claims, 8 Drawing Sheets

BOOM CONFIGURATION FOR A SKID STEER LOADER

BACKGROUND

The present application relates to a boom configuration for a skid steer loader.

SUMMARY

In some embodiments, a vehicle includes a frame having a first end and a second end, an engine connected to the frame and operable to move the vehicle, an operator cab connected to the frame, a tool, and a boom arm. The boom arm includes a first linkage having a portion coupled to the frame, a second linkage having a first portion coupled to the first linkage and a second portion, the tool being coupled to the second portion of the second linkage, and a cylinder having a first portion coupled to the first linkage and a second portion coupled to the second linkage at a location between the first portion of the second linkage and the second portion of the second linkage. The location is positioned a first distance from the first portion of the second linkage and a second distance from the second portion of the second linkage, and the second distance is greater than the first distance.

In some embodiments, a vehicle configured to travel over a ground surface includes a frame having a front end and a rear end. An engine is connected to the frame and operable to move the vehicle and a cab is connected to the frame. A boom arm includes a first linkage having a first portion connected to the frame, a second linkage having a first portion connected to a second portion of the first linkage and having a second portion, and a cylinder having a first portion connected to the first linkage and a second portion connected to the second linkage. A tool is connected to the second portion of the second linkage and is moveable from a lowered position to a raised position. The boom arm is configured such that when the tool is moved between the lowered positioned and the raised position, the second end of the second linkage travels in a path along which at least fifty percent is orthogonal to the ground surface.

In some embodiments, a vehicle includes a frame, an engine connected to the frame and operable to move the vehicle, an operator cab, a tool, and a boom arm. The boom arm includes a first linkage, a second linkage and a cylinder. The first linkage has a first portion connected to the frame and a second portion spaced from the frame. The second linkage has a first portion connected to the second portion of the first linkage and a second portion connected to the tool, the second linkage movable during boom operation within a first plane. The cylinder has a first portion connected to the first linkage and a second portion connected to the second linkage, such that the first linkage and the cylinder are movable during boom operation within a second plane. The first plane is offset from the second plane.

Other aspects of the design will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways.

Figure 1:
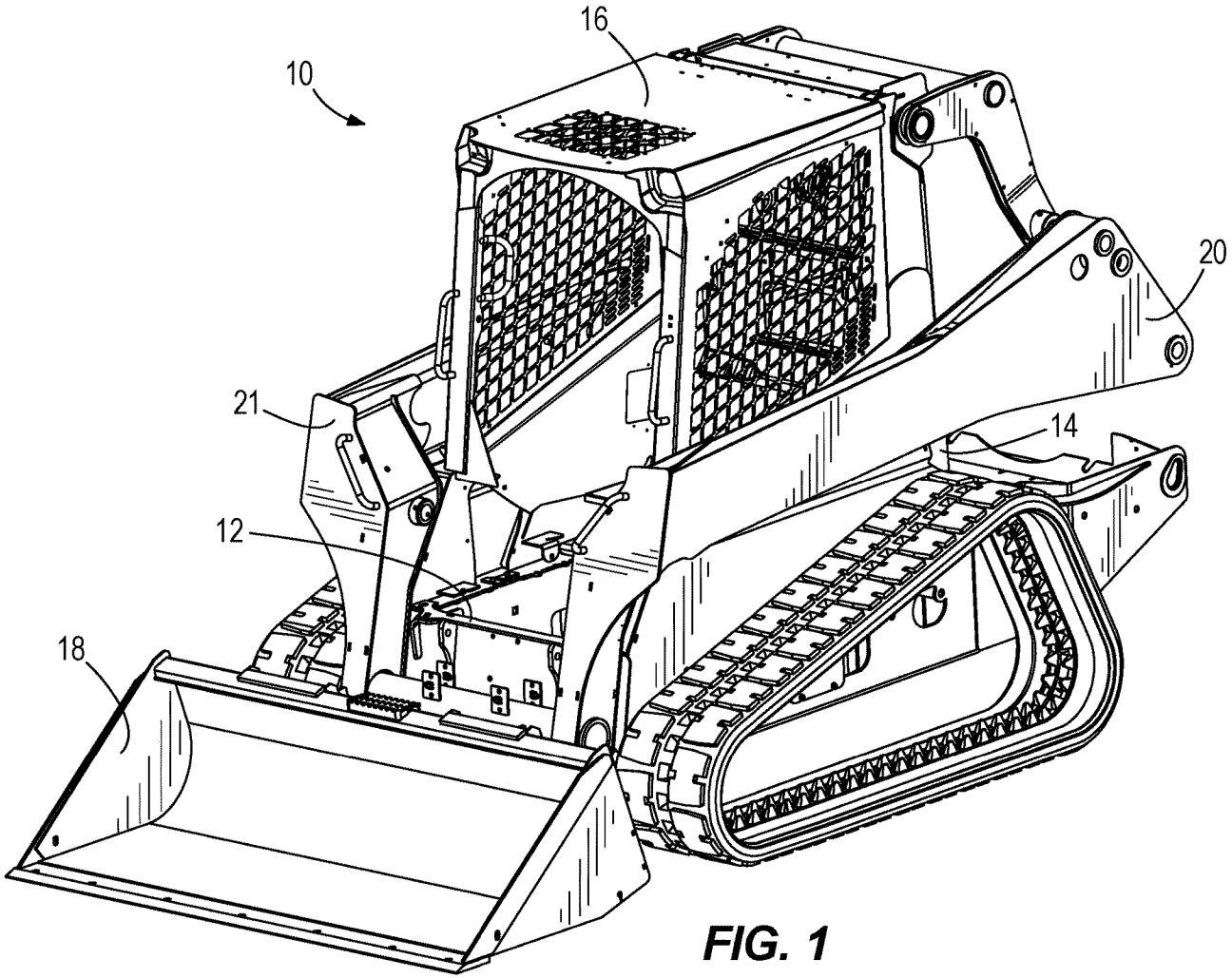
FIG. 1 is a perspective view of a skid steer loader with a bucket in a lowered position.
Figure 2:
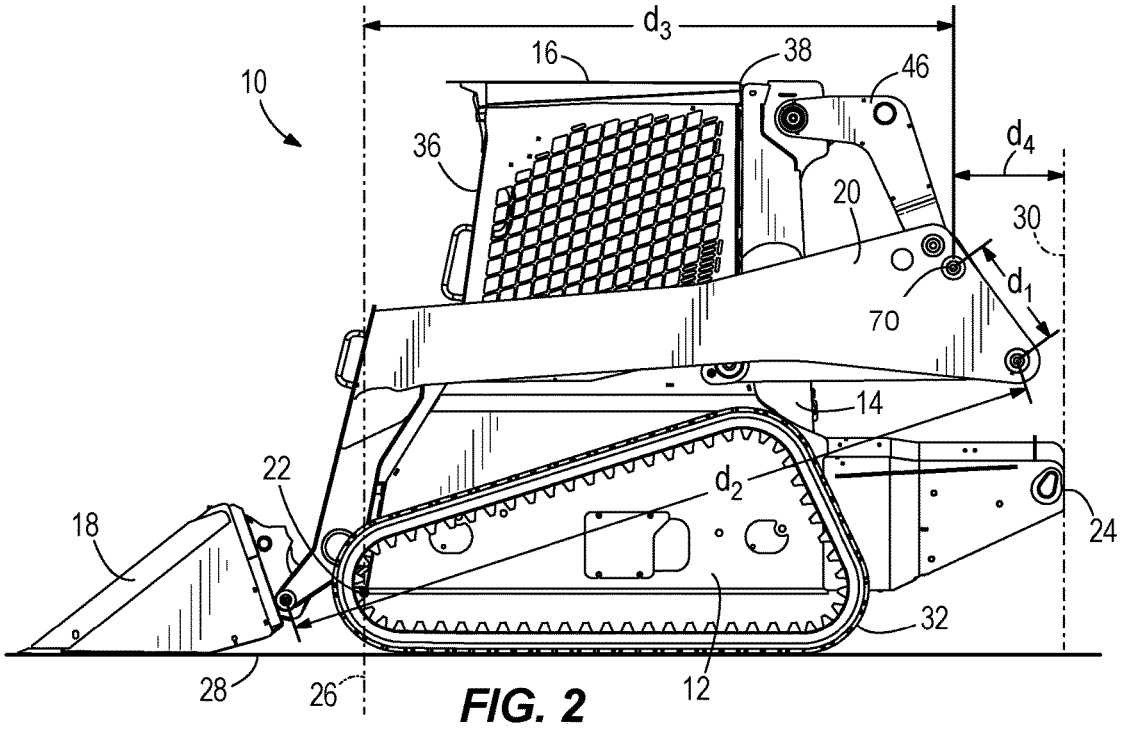
FIG. 2 is a side view of the skid steer loader of FIG. 1.
Figure 3:
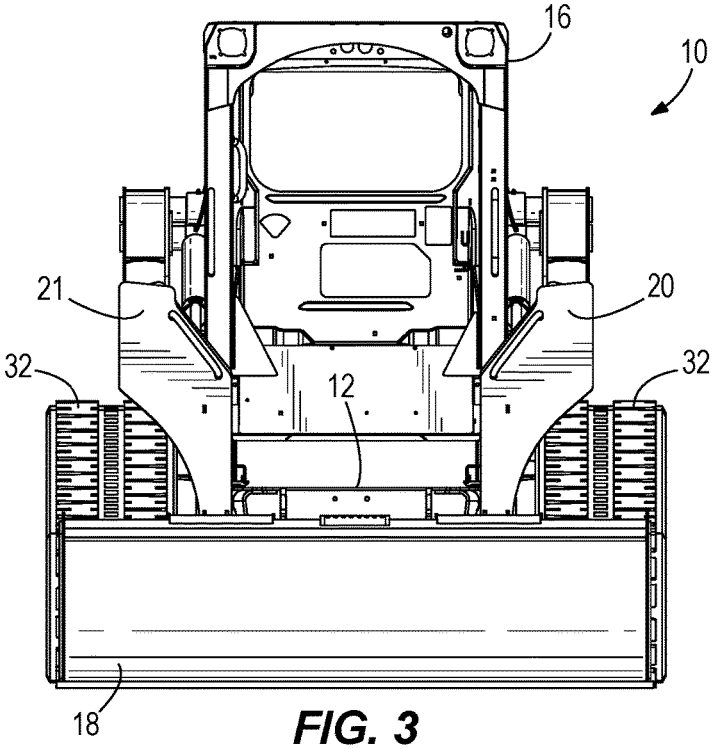
FIG. 3 is a front view of the skid steer loader of FIGS. 1-2.

FIGS. 1-3 show a vehicle 10 including a frame 12, an engine 14, an operator cab 16, a tool 18, and first and second parallel boom arms 20, 21. The frame 12 has a front end, portion, or section 22 and a rear end, portion, or section 24 such that a first plane 26 can be identified tangent to the frame first end 22 and extending orthogonal to a surface 28 on which the vehicle 10 is configured to travel, and a second plane 30 can be identified tangent to the frame second end 24 and extending orthogonal to the surface 28.

The engine 14 is coupled to the frame 12 and is operable to move the vehicle 10. The illustrated vehicle includes tracks 32, but other embodiments can include one or more wheels that engage the surface 28. One or more rollers, including a drive roller, are operable to engage and move the tracks 32. The rollers are omitted for clarity. While the illustrated vehicle 10 is a skid steer loader, some embodiments of the present application include a compact track loader.

The operator cab 16 is coupled to the frame 12 and has a front end, portion or section 36 and a rear end, portion or section 38. The entirety of the cab 16 (i.e., the front end 36 and the cab rear end 38) is situated between the frame front end 22 and the frame rear end 24.

The illustrated tool 18 is a bucket, but other tools can be utilized. The bucket 18 is coupled to the first and second boom arms 20, 21, which can be articulated to raise and lower the bucket 18 as well as tilt the bucket 18 for filling and emptying.

FIGS. 4-6 and 8 show that the first boom arm 20 is a substantial mirror image of the second boom arm 21. Each of the boom arms 20, 21 includes a first linkage 40, a second linkage 42, a cylinder 44, and a third linkage 46. The first linkage 40 includes a first end, portion, or section 48 and a second end, portion, or section 50, as well as a first pivot point 52, second pivot point 54, and a third pivot point 56. The illustrated first pivot point 52 is positioned near the first end 48, the illustrated second pivot point 54 is positioned near the second end 50 and the illustrated third pivot point 56 is positioned near the first end 48. The first linkage further defines a longitudinal axis 58 passing through pivot points 52 and 54.

The first end 48 is pivotally coupled to the frame 12 at the first pivot point 52 between the first plane 26 and the second plane 30. The second end 50 is spaced further from the frame 12 than is the first end 48 and is positioned closer to the second plane 30 than to the first end 48. The second end 50 is moveable with respect to the frame 12 when the first end 48 pivots with respect to the frame 12.

The second linkage 42 includes a first end, portion, or section 62, a second end, portion, or section 64, a first pivot point 66, a second pivot point 68 and a third pivot point 70. The illustrated first pivot point 66 is positioned near the first end 62 and the illustrated second pivot point 68 is positioned near the second end 64. The first pivot point 66 of the second linkage 42 is coupled to the second pivot point 54 of the first linkage 40 for rotation about the first linkage 40.

The illustrated third pivot point 70 is positioned on the second linkage 42 between the first end 62 and the second end 64. Specifically, as show in FIG. 2, the illustrated third pivot point 70 is positioned a first distance d1 from the first pivot point 66 of the second linkage 42 and a second distance d2 from the second pivot point 68 of the second linkage 42. The second distance d2 is greater than the first distance d1. In some embodiments, the second distance d2 is more than two times greater than the first distance d1.

Figure 6:
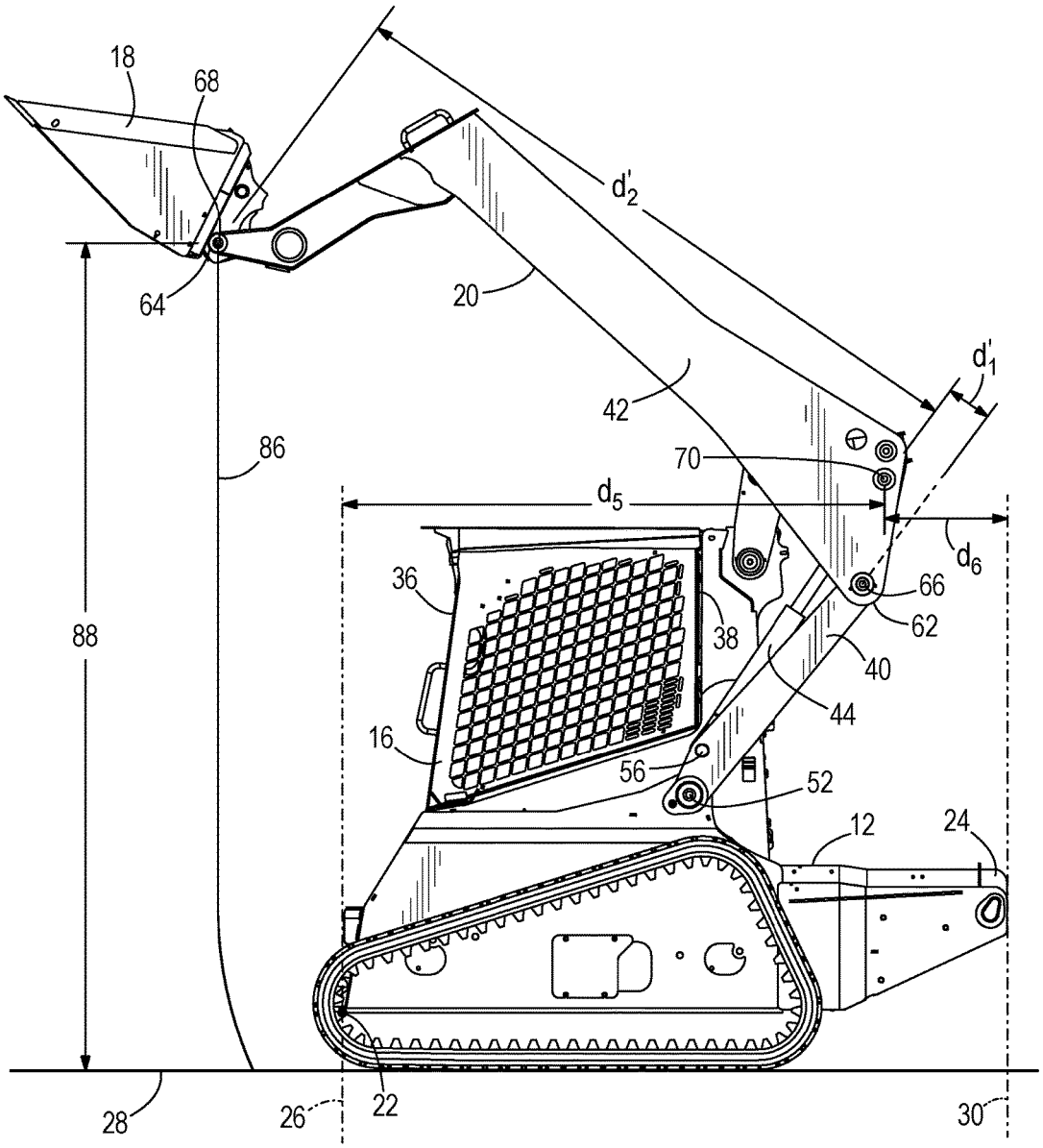
FIG. 6 is a side view of the skid steer loader of FIG. 5.

As shown in FIG. 6, the distances between the third pivot point 70 and the first and second points 66 and 68 are measured parallel to the elongate direction of the second linkage 42. The third pivot point 70 is positioned a first distance d1' from the first pivot point 66 and is positioned a second distance d2' from the second pivot point 68. The second distance d2' is greater than the first distance d1'. In some embodiments, the second distance d2' is more than two times greater than the first distance d1'. The aforementioned relationship between distance d1' and distance d2' remains constant during operation. The tool 18 is coupled to the second pivot point 68 such that the tool 18 can rotate with respect to the second linkage 42. Alternatively, the distance between the third pivot point 70 and the first pivot point 66, and the distance between the third pivot point 70 and the second pivot point 68 can be measured in a direction orthogonal to the plane 30, in which case the relative distances may change during operation due to rotation of the second linkage 42 about the first pivot point 66. Although these distances may change, the distance between the third pivot point 70 and the first pivot point 66 will be less than the distance between the third pivot point 70 and the second pivot point 68 throughout operation.

The cylinder 44 has a first end, portion, or section 74, a second end, portion, or section 76, a first pivot point 78, a second pivot point 80 and an axis 82 extending through the first pivot point 78 and the second pivot point 80. The illustrated first pivot point 78 is positioned near the first end 74 and the second pivot point 80 is positioned near the second end 76. The first pivot point 78 is coupled to the third pivot point 56 of the first linkage 40. The second pivot point 80 is coupled to the third pivot point 70 of the second linkage 42.

The third linkage 46 is coupled to the second linkage 42 and the cab 16 and is generally "L" shaped.

Figure 4:
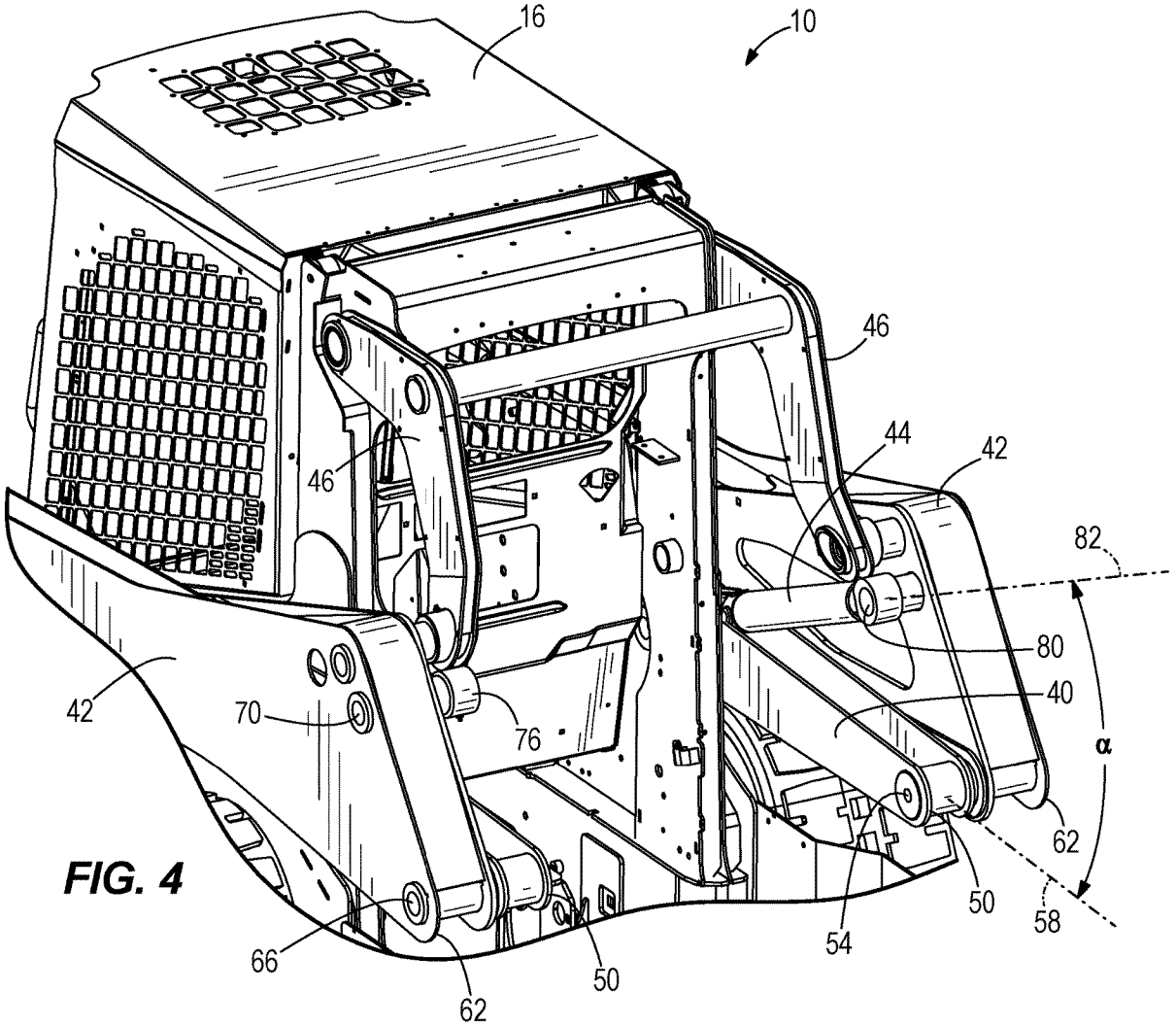
FIG. 4 is a partial rear perspective view of the skid steer loader of FIGS. 1-3.
Figure 5:
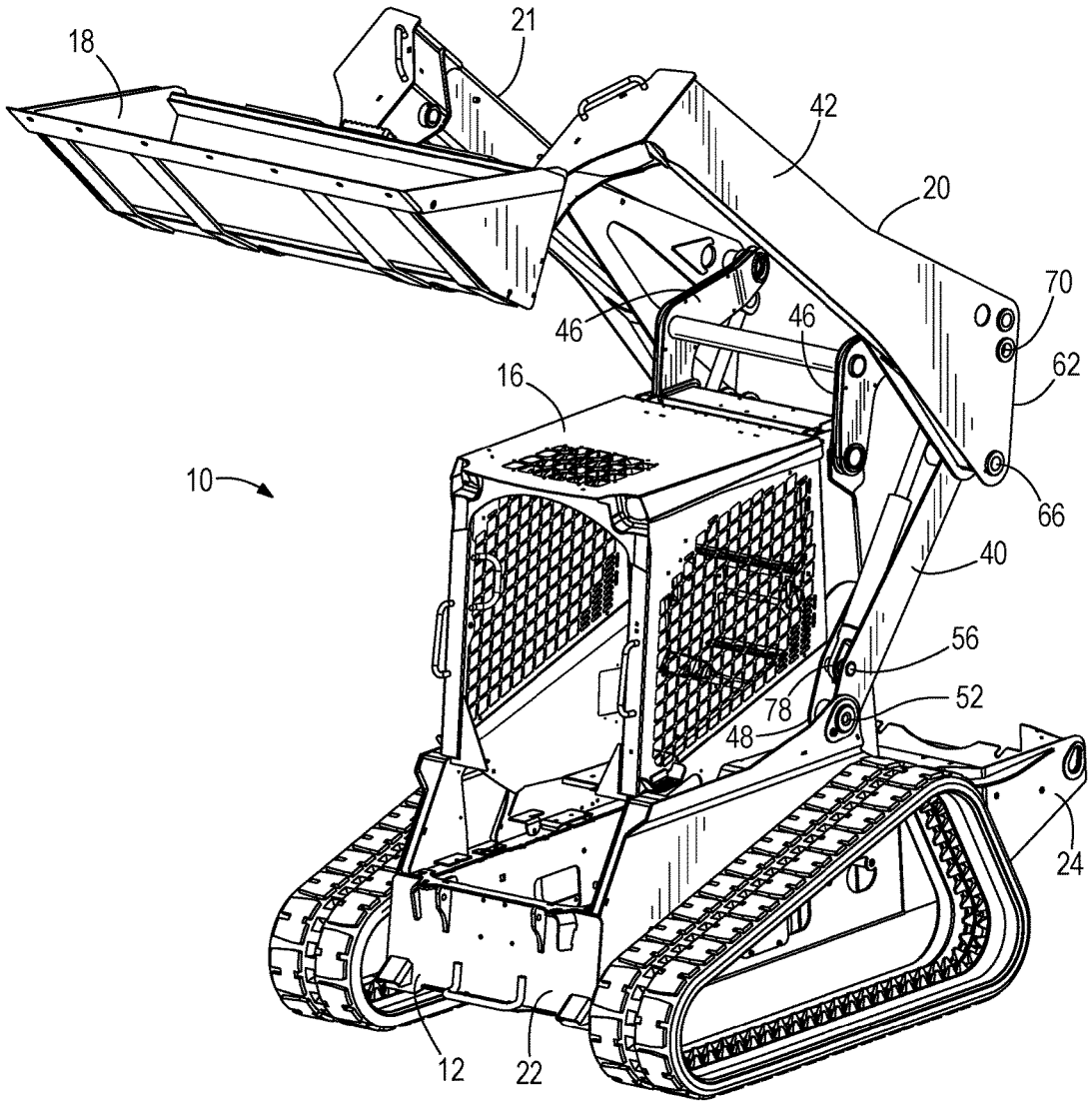
FIG. 5 is a perspective view of a skid steer loader with the bucket in a raised position.
Figure 8:
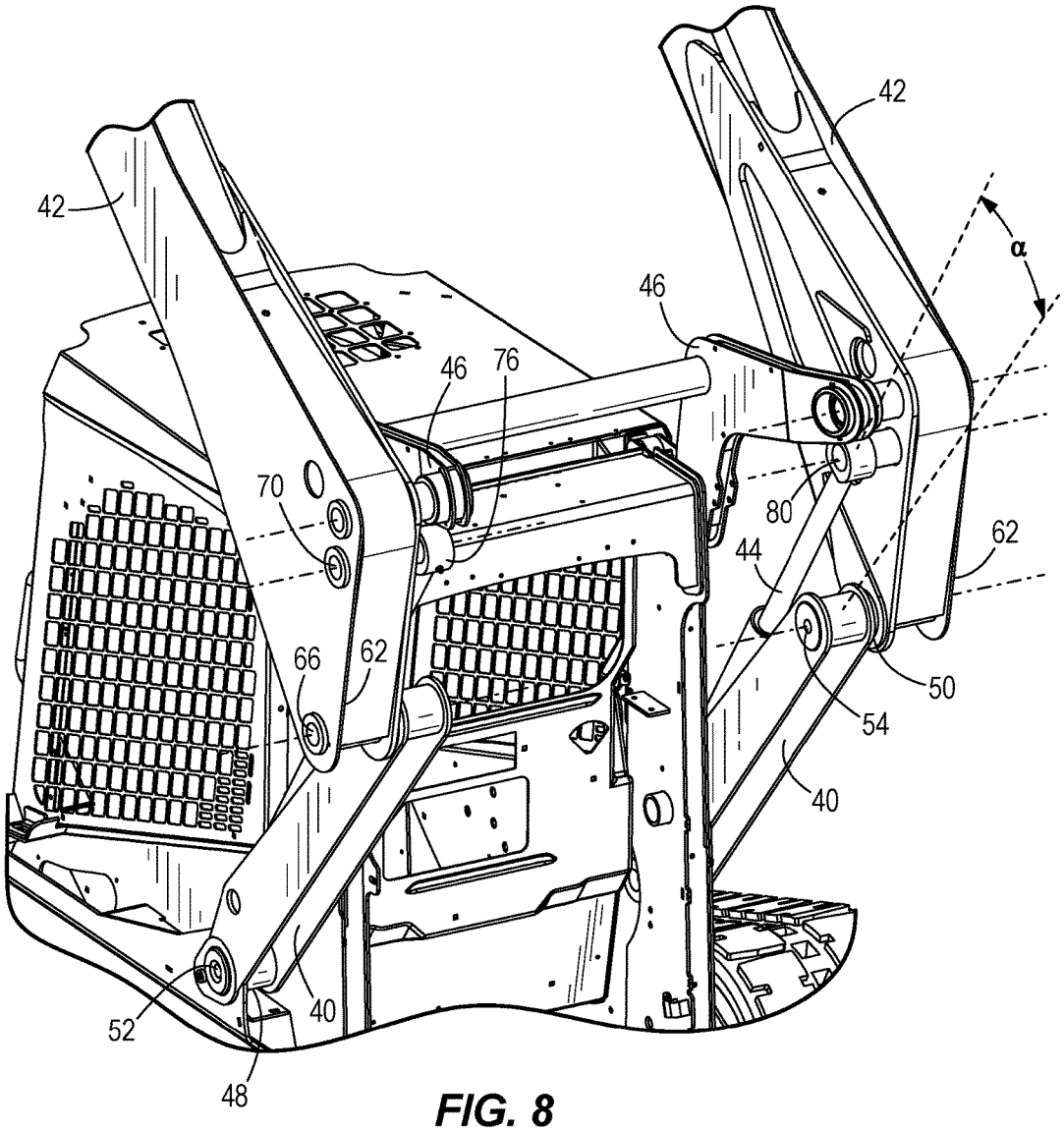
FIG. 8 is a partial rear perspective view of the skid steer loader of FIGS. 5-7.

With reference to FIGS. 4 and 8, the first linkage axis 58 extends at an angle $\alpha$ with respect to the cylinder axis 82. The angle $\alpha$ is less than thirty degrees when the tool 18 is in a lowered position as shown in FIG. 4. The angle $\alpha$ is also less than thirty degrees when the tool 18 is in a raised position as shown in FIG. 8. At all locations between the raised and lowered positions, the angle $\alpha$ is less than thirty degrees.

With reference to FIG. 6, the first portion 48 of the first linkage 40 is positioned near the cab rear end 38 and the second portion 50 of the first linkage 40 is positioned near the frame rear end 24. As shown in the illustrated embodiment, the second portion 76 of the cylinder 44 is positioned closer to the second plane 30 than to the first plane 26 throughout the travel path of the bucket 18. In some embodiments, a distance between the second portion 76 of the cylinder 44 and the first plane 26 is more than two times greater than a distance between the second portion 76 of the cylinder 44 and the second plane 26 (in a direction orthogonal to the planes 26, 30) throughout the travel path of the bucket 18.

The illustrated boom arms 20, 21 are configured such that when the tool 18 is moved between the lowered positioned and the raised position, the second end 64 of the second linkage 42 travels in a path 86 along which at least fifty percent is orthogonal to the ground surface 28. In some embodiments, at least sixty percent of the travel path 86 is orthogonal to the ground surface 28. In some embodiments, two thirds or more of the travel path 86 is orthogonal to the ground surface 28. The raised height 88 of the second pivot point 68 is shown in FIG. 6. The raised height 88 is slightly smaller than the length of the travel path 86 because the raised height 88 is straight and the travel path has a slight curve toward the ground surface 28.

With reference to FIGS. 2 and 6, the third pivot point 70 of the second linkage 42 (which is coincident with the second pivot point 80 of the cylinder 44) is positioned a distance d3 from the frame front end 22 as measured orthogonally from the first plane 26, and a distance d4 from the frame rear end 24 as measured orthogonally from the second plane 30 when the tool 18 is in the lowered position. The distance d3 is greater than the distance d4. Also, the second pivot point 70 of the second linkage 42 (which is coincident with the second pivot point 80 of the cylinder 44) is positioned a distance d5 from the frame front end 22 and a distance d6 from the frame rear end 24 when the tool 18 is in the raised position; the distance d5 is greater than the distance d6.

Figure 7:
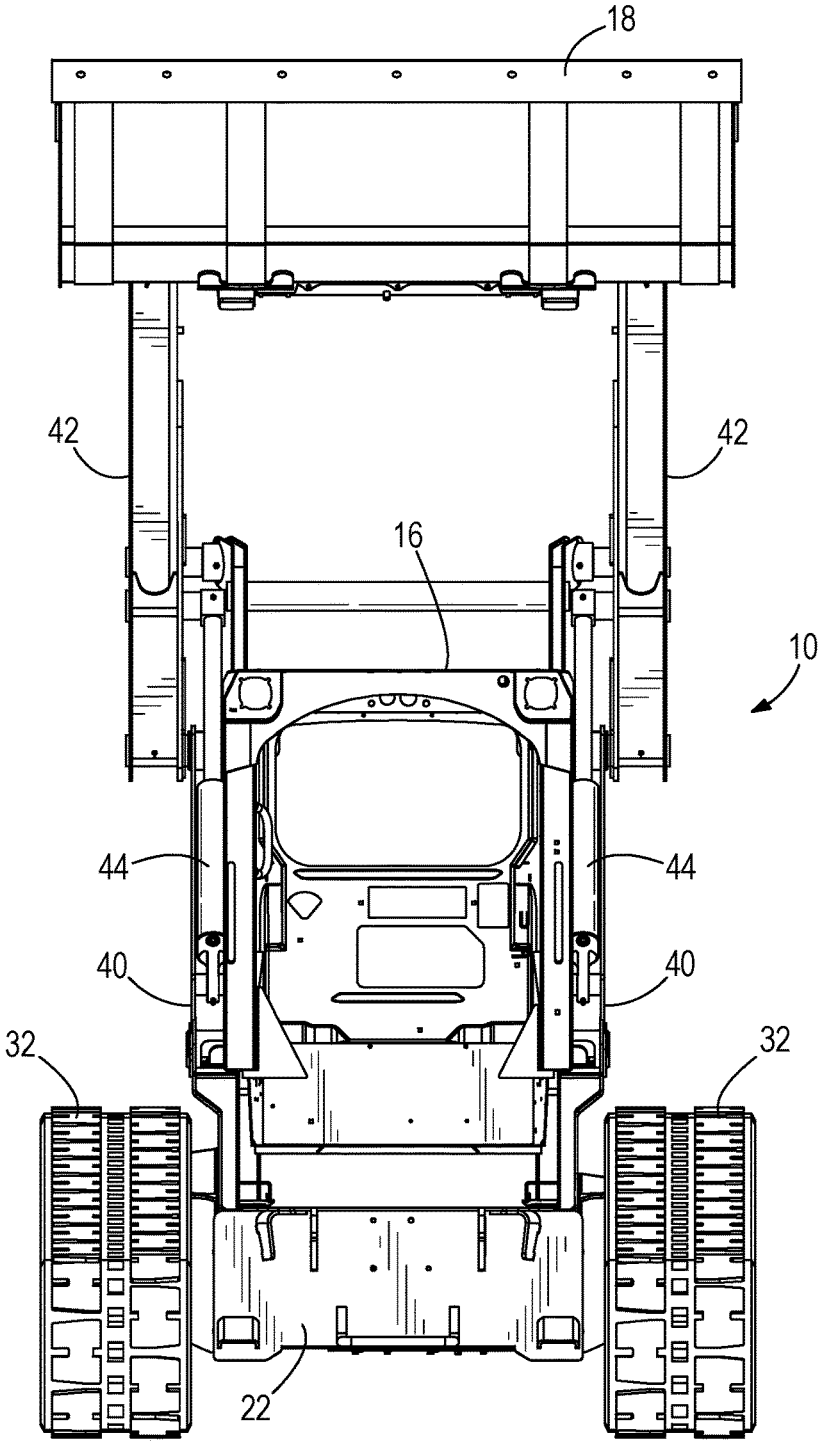
FIG. 7 is a front view of the skid steer loader of FIGS. 5-6.
Figure 9:
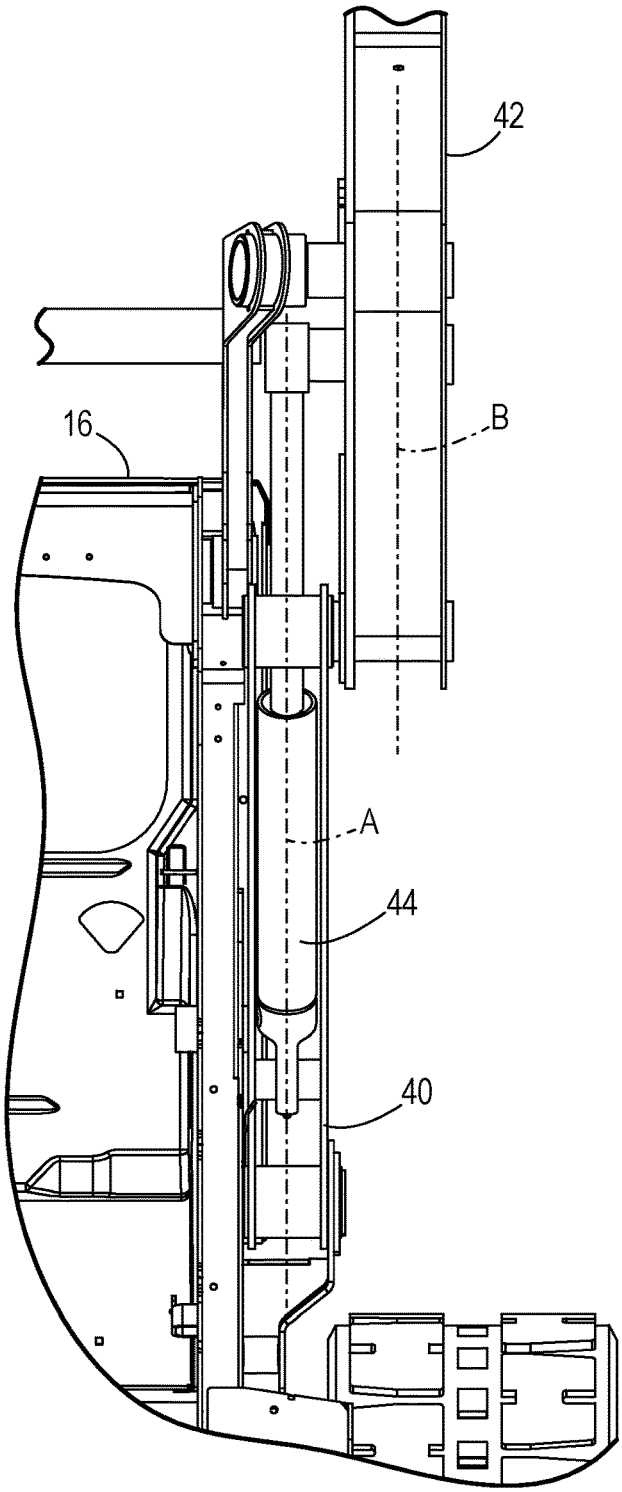
FIG. 9 is a close up rear view of an arm of the skid steer loader of FIGS. 5-8.

With reference to FIGS. 7-9, the first linkage 40 and the cylinder 44 are positioned laterally between the cab 16 and the second linkage 42. Specifically, the cylinder 44 and the first linkage 40 extend along a common plane A that passes through pivot points 52, 54 and is coincident with axes 58 and 82. The plane A is offset or spaced from the cab 16. A portion of the second linkage 42 extends along a plane B that passes through pivot point 66 (see FIG. 9). The plane B is offset or spaced from the plane A. The common plane A is positioned closer to the cab 16 than the plane B.

In operation, actuation of the cylinder 44, coupled at connection points 56, 70, acts to rotate the second linkage 42 about the pivot point 66 from the lowered position of FIG. 2 to the raised position of FIG. 6 and back concurrently with rotation of the first linkage 40 about the first pivot point 52. Because the first linkage 40, the second linkage 42 and the cylinder 44 are interconnected, lengthening or shortening of the cylinder 44 causes movement of both the first linkage 40 and the second linkage 42. The third linkage 46 connects the second linkage 42 to the cab 16 such that lengthening or shortening of the cylinder 44 also causes movement of the third linkage 46.

The linkage geometry of the present application allows for more efficient use of the hydraulic capability of the vehicle, thus resulting in increased boom breakout forces throughout the lift path, thereby increasing loader lift capacity for a given amount of hydraulic force exerted.

Specifically, though a hydraulic cylinder typically exerts the same force throughout the skid steer lift path, the amount of force generated at the bucket cutting edge, which is referred to as boom breakout, varies. The present linkage maximizes boom breakout at ground level in order to break material out of a compacted pile. Increasing boom breakout, however, has historically been a tradeoff with the ability of the linkages to lift a load to full height. By configuring the linkages and cylinder of the boom arm as shown and described, the present construction of the linkage better utilizes the energy of the hydraulic cylinders for the skid steer application.

The location of the pivot points 52, 56 with respect to the cab 16 can provide better visibility for an operator than provided by the prior art. Many prior art designs block at least a portion of the cab 16 with the boom arm during portions of operation. The present design positions the pivot points 52, 56 toward the rear of the cab 16 to increase operator visibility throughout operation.

Further, each cylinder 44 is offset from the second linkage 42 towards the center of the vehicle 10 and is mounted on the first linkage 40 in order to enhance the boom breakout force at the ground while maintaining a greater lifting force through the lift path. And the cylinders 44, while actuating the boom arms 20, 21, also move along with it, thereby reducing the cylinder stroke requirement necessary to achieve the same bucket height.

Various features and advantages of the disclosure are set forth in the following claims.

What is claimed is:

1. A vehicle comprising:

a frame;

an engine coupled to the frame and operable to move the vehicle;

an operator cab;

a tool; and a boom arm including a first linkage having a first portion coupled to the frame and a second portion spaced from the frame, a second linkage having a first portion coupled to the second portion of the first linkage and a second portion coupled to the tool, the first portion of the second linkage movable during boom operation within a first plane, and a cylinder having a first portion directly coupled to the first linkage and a second portion coupled to the second linkage, the first linkage and the cylinder movable during boom operation within a second plane, wherein the first plane is offset from the second plane.

2. The vehicle of claim 1, wherein the second plane is between the first plane and the cab.

3. The vehicle of claim 1, wherein when the tool is in a fully lowered position the cylinder extends in a cylinder direction and the first linkage extends in a first direction, and wherein the angle therebetween is less than 30 degrees.

4. The vehicle of claim 1, wherein the first portion of the cylinder is directly coupled to the first portion of the first linkage and the second portion of the cylinder is coupled to the first portion of the second linkage.

5. The vehicle of claim 1, wherein the frame has a frame front end and a frame rear end, wherein the second portion of the cylinder is positioned a first distance from the frame front end and a second distance from the frame rear end when the tool is in the lowered position, wherein the first distance is greater than the second distance, wherein the second portion of the cylinder is positioned a third distance from the frame front end and a fourth distance from the frame rear end when the tool is in the raised position, and wherein the third distance is greater than the fourth distance.

6. The vehicle of claim 1, wherein the boom arm is configured such that when the tool is moved between a fully lowered positioned and a fully raised position, the second portion of the second linkage travels in a path along which at least fifty percent is orthogonal to a ground surface over which the vehicle travels.

* * * * *